US008333305B2

(12) United States Patent
Kim et al.

(10) Patent No.: US 8,333,305 B2
(45) Date of Patent: Dec. 18, 2012

(54) REFRIGERATOR HAVING DISPENSER

(75) Inventors: Seong-Jae Kim, Seoul (KR); Nam-Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 753 days.

(21) Appl. No.: 12/476,393

(22) Filed: Jun. 2, 2009

(65) Prior Publication Data

US 2010/0082159 A1 Apr. 1, 2010

(30) Foreign Application Priority Data

Sep. 30, 2008 (KR) ..... 10-2008-0096292

(51) Int. Cl.
*B67D 7/06* (2010.01)

(52) U.S. Cl. ..... 222/504; 222/48; 222/49; 222/146.6; 222/505; 62/391; 141/351; 141/357; 141/361

(58) Field of Classification Search ..... 141/321, 141/344, 345, 351, 357, 360–362; 62/389, 62/391; 222/41, 48, 49, 146.6, 504, 505
See application file for complete search history.

(56) References Cited

U.S. PATENT DOCUMENTS 5,881,930 A * 3/1999 Lee ..... 222/509
2003/0019236 A1 1/2003 Heims et al.
2006/0201194 A1 9/2006 Bowen et al.

FOREIGN PATENT DOCUMENTS

KR 10-0162443 B1 8/1998
KR 10-0283780 B1 12/2000
KR 10-0766119 B1 10/2007

OTHER PUBLICATIONS

International Search Report & Written Opinion issued in Application No. PCT/KR2009/003086, mailed Feb. 17, 2010, 11 pages.

* cited by examiner

*Primary Examiner* — Jason Boeckmann
(74) *Attorney, Agent, or Firm* — Fish & Richardson P.C.

(57) ABSTRACT

A refrigerator includes a cooling chamber, a door that is configured to open and close at least a portion of the cooling chamber, and a dispenser positioned on the door and configured to dispense ice pieces or water through the door when the door is oriented in a closed position. The refrigerator also includes a dispensing button unit configured to control a dispensing start time and a dispensing speed of the ice pieces or water dispensed through the dispenser based on a position of at least a portion of the dispensing button unit that results from movement of the portion of the dispensing button unit.

15 Claims, 13 Drawing Sheets

REFRIGERATOR HAVING DISPENSER

CROSS REFERENCE TO RELATED APPLICATIONS

The present application claims the benefit of priority to Korean Application 10-2008-0096292, filed on Sep. 30, 2008, which is herein expressly incorporated by reference in its entirety.

FIELD

This disclosure relates to a refrigerator having a dispenser capable of to dispensing ice and/or water.

BACKGROUND

In general, a refrigerator serves to store items, such as food and beverage, at a temperature cooler than ambient room temperature. The refrigerator stores the items in a cooled state or in a frozen state.

To this end, the refrigerator is provided with a refrigeration cycle composed of compression, condensation, expansion, and evaporation processes that use a refrigerant as a fluid. As the refrigeration cycle is repeated, cool air is generated. Then, the cool air is evenly supplied to an interior of the refrigerator, thereby allowing the refrigerator to maintain a relatively cool inner temperature.

SUMMARY

In one aspect, a refrigerator includes a cooling chamber, a door that is configured to open and close at least a portion of the cooling chamber, and a dispenser positioned on the door and configured to dispense ice pieces or water through the door when the door is oriented in a closed position. The refrigerator also includes a dispensing button unit configured to control a dispensing start time and a dispensing speed of the ice pieces or water dispensed through the dispenser based on a position of at least a portion of the dispensing button unit that results from movement of the portion of the dispensing button unit. The dispensing button unit is configured to, in response to the portion of the dispensing button unit being moved to a first position, control the dispenser to start dispensing the ice pieces or water at a first speed and is configured to, in response to the portion of the dispensing button unit being moved to a second position that is different than the first position, control the dispenser to change a dispensing speed of the ice pieces or water to a second speed that is different than the first speed.

Implementations may include one or more of the following features. For example, the portion of the dispensing button unit may include a lever portion that is configured to generate a dispensing start signal when the lever portion is moved, toward the cooling chamber when the door is oriented in the closed position, to the first position and that is configured to generate a dispensing speed signal when the lever portion is moved, toward the cooling chamber when the door is oriented in the closed position, from the first position to the second position.

In some implementations, the refrigerator may include a dispensing start switch that is positioned to contact the lever portion when the lever portion is moved to the first position and that is configured to generate the dispensing start signal when contacted by the lever portion and a dispensing speed switch that is positioned to contact the lever portion when the lever portion is moved to the second position and that is configured to generate the dispensing speed signal when contacted by the lever portion. In these implementations, the dispensing button unit may include a lever frame portion configured to move, in a plane perpendicular to a surface of the door, between a stored position at which the lever frame portion is positioned on a side of the surface of the door where the cooling chamber is positioned and an extended position at which at least a portion of the lever frame portion is positioned on a side of the surface of the door opposite of the cooling chamber and a lever portion that is elastically supported by the lever frame portion and that is configured to, when the lever frame portion is oriented in the extended position, move, in response to application of force to the lever portion, toward the surface of the door and move, in response to release of the force applied to the lever portion, away from the surface of the door.

The refrigerator may include a position informing unit that is configured to enhance user detection that, subsequent to the lever portion being moved to the first position at which the lever portion contacts the dispensing start switch, the lever portion is disposed at a position before contacting the dispensing speed switch. The position informing unit may include a locking protrusion that is elastically supported at one of the lever portion and the lever frame portion and a locking groove that is defined at the other of the lever portion and the lever frame portion and that is configured to contact the locking protrusion subsequent to the lever portion being moved to the first position at which the lever portion contacts the dispensing start switch and prior to the lever portion being moved to the second position at which the lever portion contacts the dispensing speed switch. Contact between the locking protrusion and the locking groove may cause additional resistance in moving the lever portion toward the surface of the door and, thereby, enhances user detection that the lever portion is disposed at a position before contacting the dispensing speed switch.

The locking protrusion may be elastically supported by a contact surface between the lever portion and the lever frame portion in a vertical direction. The locking protrusion may have sequentially an upward inclination portion and a downward inclination portion along a moving direction of the lever portion.

In some examples, when the door is oriented in the closed position, the dispenser may define an ice flow passage that enables passage of ice pieces through the door from an outlet of an ice bank that is disposed in the cooling chamber and that is configured to store ice pieces. In these examples, the dispenser may include a fixed guide portion configured to communicate with the outlet of the ice bank; and a movable guide portion that is configured to rotate between a stored position and a dispensing position and that is configured to communicate the fixed guide portion with an exterior of the cooling chamber when the movable guide portion is oriented in the dispensing position. The movable guide portion may be coupled to a cover portion that is configured to rotate between a stored position at which the cover portion is positioned in a plane of an external surface of the door and a dispensing position at which at least a portion of the cover portion is positioned on a side of the surface of the door opposite of the cooling chamber and at which the movable guide portion communicates with the fixed guide portion. The dispensing button unit may be positioned behind the cover portion when the cover portion is oriented in the stored position, and at least a portion of the dispensing button unit may be positioned on the side of the surface of the door opposite of the cooling chamber when the cover portion is oriented in the dispensing position.

In some implementations, the dispensing button unit may include a pressing portion disposed at an inner side of a concaved region of the door, a dispensing start switch configured to generate a dispensing start signal when contacted, a dispensing speed switch configured to generate a dispensing speed signal when contacted, and a switch operating portion that is configured to move in response to force applied to the pressing portion, that is configured to, when the door is oriented in the closed position and force is applied to the pressing portion, move toward the cooling chamber to the first position at which the switch operating portion contacts the dispensing start switch, and that is configured to, when the door is oriented in the closed position, the switch operating portion is positioned at the first position, and force is applied to the pressing portion, move toward the cooling chamber to the second position at which the switch operating portion contacts the dispensing speed switch. In these implementations, when the door is oriented in the closed position, the dispenser may define an ice flow passage between one side of the concaved region and an outlet of an ice bank that is disposed in the cooling chamber and that is configured to store ice pieces. The pressing portion may be provided on a wall surface inside the concaved region and is elastically supported in a thickness direction of the door. The pressing portion may be coupled to the door by hinges, may be configured to rotate in a thickness direction of the door, may be provided on a wall surface inside the concaved region, and may be elastically supported in a manner that applies a force to rotate the pressing portion toward a front surface of the door.

In another aspect, a method of controlling a dispenser includes receiving force that moves a portion of a dispensing button to a first position and controlling a dispenser to start dispensing ice pieces or water at a first speed in response to the portion of the dispensing button unit being moved to the first position. The method also includes receiving force that moves the portion of the dispensing button from the first position to a second position that is different than the first position and controlling the dispenser to change a dispensing speed of the ice pieces or water to a second speed that is different than the first speed in response to the portion of the dispensing button unit being moved to the second position.

Implementations may include one or more of the following features. For example, the method may include providing a physical alert to a user indicating that the portion of the dispensing button unit is approaching the second position at which the dispensing speed of the ice pieces or water changes. The method also may include causing an increase in force needed to complete movement of the portion of the dispensing button from the first position to the second position.

In yet another aspect, a refrigerator includes a cooling chamber, a door that is configured to open and close at least a portion of the cooling chamber, and a dispenser positioned on the door and configured to dispense ice pieces or water through the door when the door is oriented in a closed position. The refrigerator also includes a dispensing button unit configured to receive force that results in movement of at least a portion of the dispensing button unit. The refrigerator further includes means for controlling the dispenser to start dispensing the ice pieces or water at a first speed in response to the portion of the dispensing button unit being moved to a first position and means for controlling the dispenser to change a dispensing speed of the ice pieces or water to a second speed that is different than the first speed in response to the portion of the dispensing button unit being moved to a second position that is different than the first position.

The details of one or more implementations are set forth in the accompanying drawings and the description below. Other features will be apparent from the description and drawings, and from the claims.

DETAILED DESCRIPTION

Figure 1:
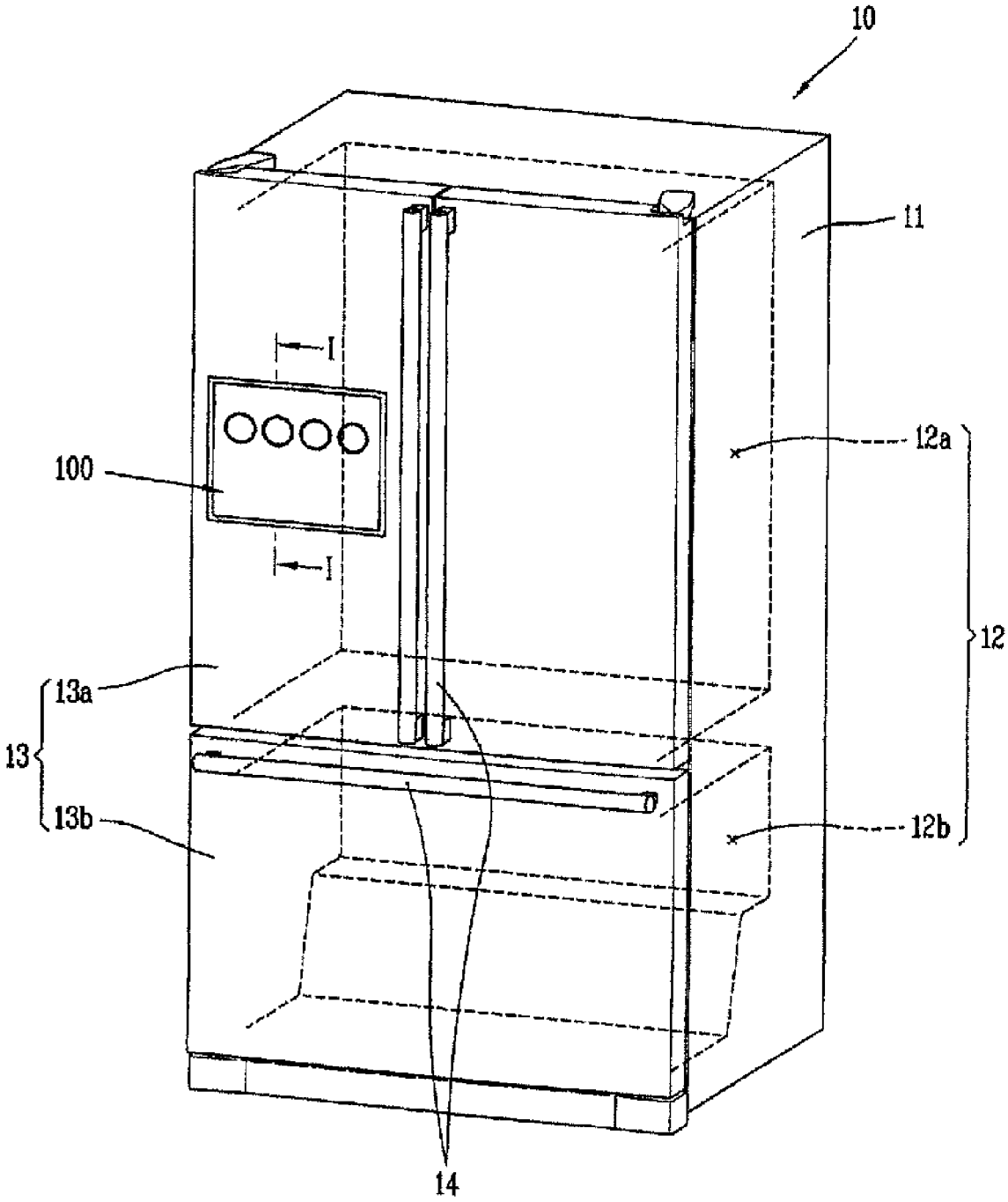
FIG. 1 is a view showing a refrigerator having a dispenser.
Figure 2:
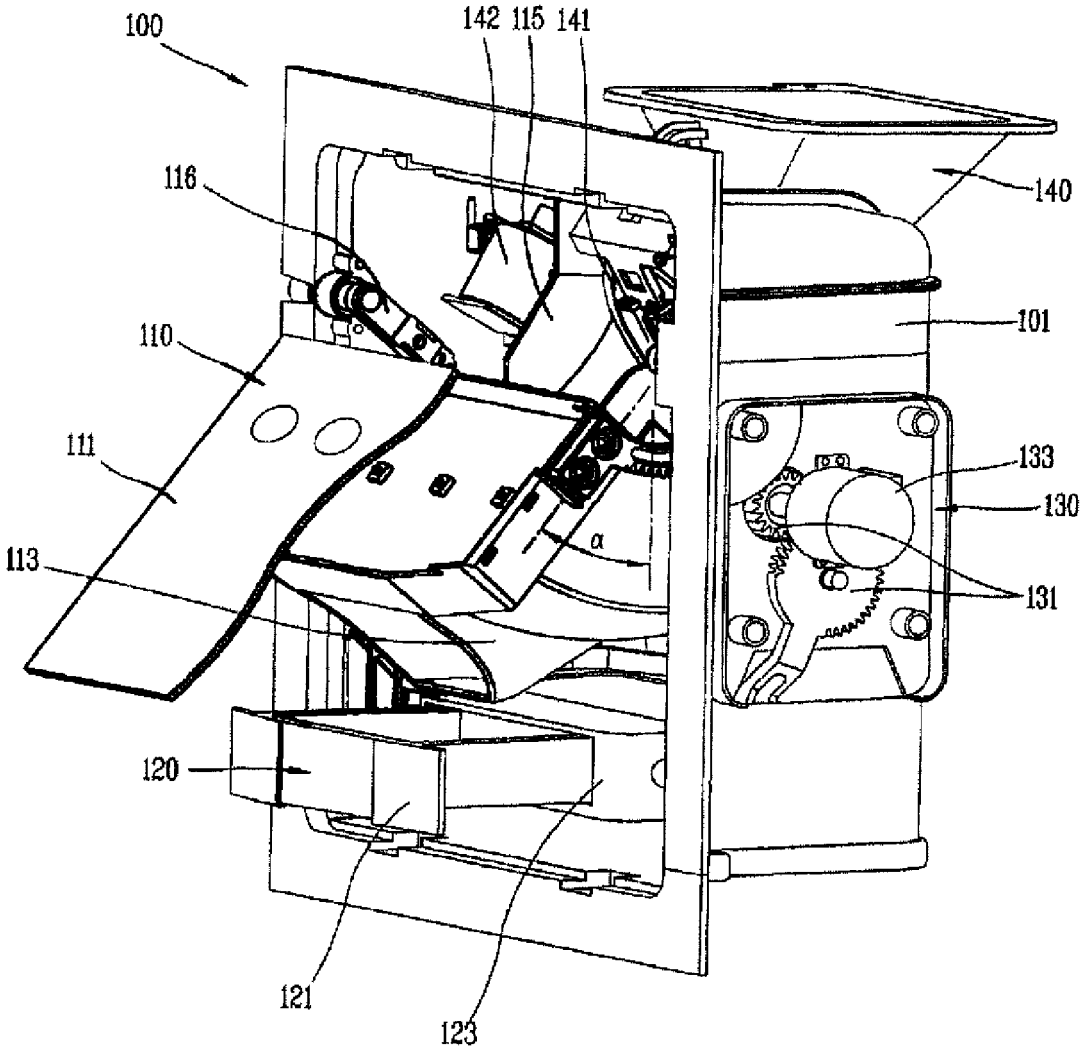
FIG. 2 is a perspective view showing an inner structure of the dispenser of FIG. 1.
Figure 3:
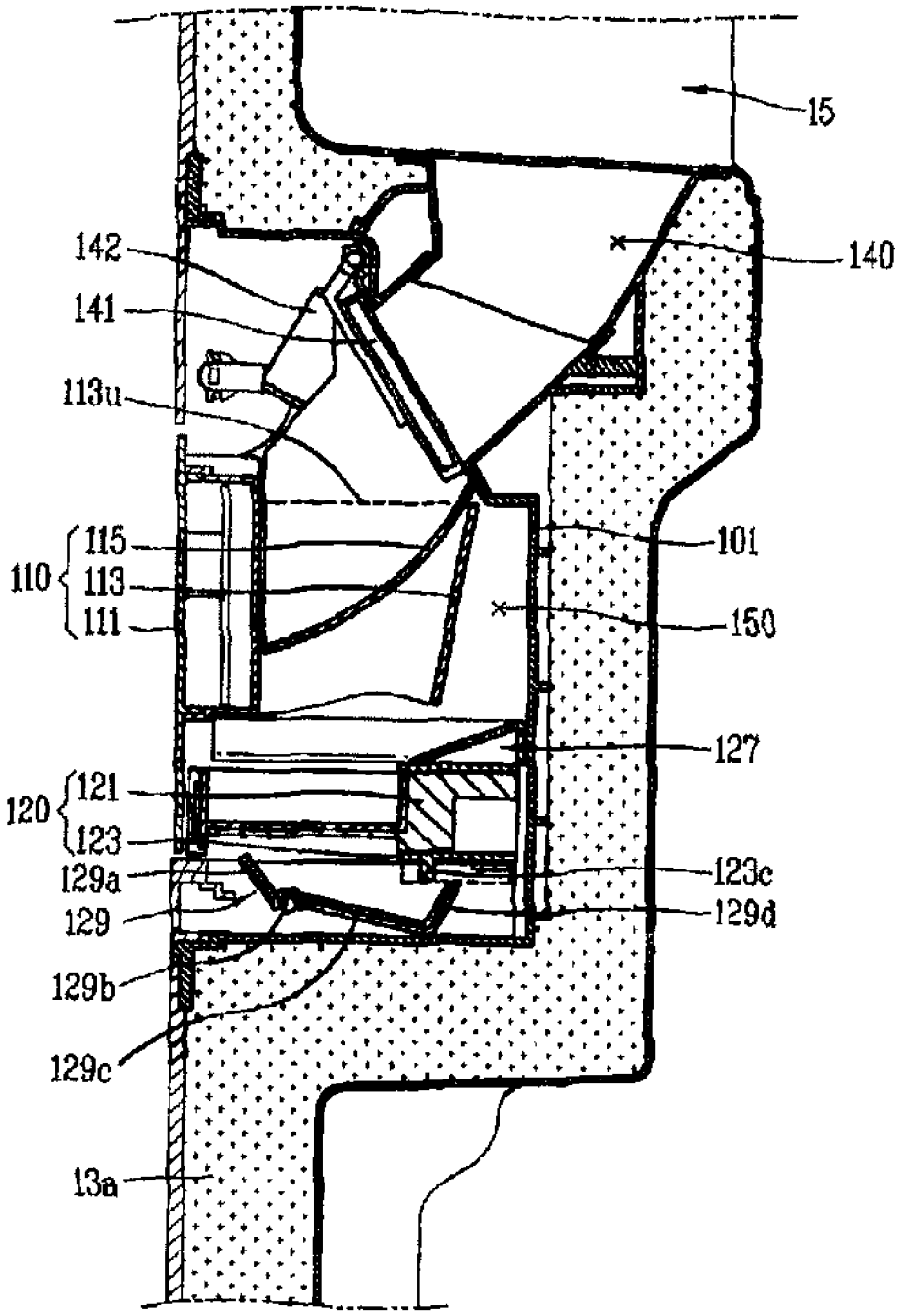
FIG. 3 is a sectional view taken along line 'I-I' in FIG. 1.

FIG. 1 illustrates an example of a refrigerator having a dispenser, FIG. 2 illustrates an inner structure of the dispenser of FIG. 1, and FIG. 3 illustrates the dispenser along line 'I-I' in FIG. 1.

Referring to FIGS. 1 to 3, a refrigerator 10 comprises a cooling chamber 12 for storing items, and a door 13 for shielding the cooling chamber 12 from outside.

The cooling chamber 12 is positioned in a body 11 that defines an external appearance of the refrigerator 10. A gap exists between an inner surface of the cooling chamber 12 and an outer surface of the body 11, and a heat insulator is positioned within the gap. The heat insulator insulates the inside of the cooling chamber 12 from outside of the body 11.

The cooling chamber 12 has one opened surface through which items can be received into or taken out of the cooling chamber 12. The opened surface is open and closed by one or more doors 13 that are coupled to the body 11 by hinges.

The heat insulator is also positioned within the door 13. The heat insulator reduces heat transfer to inside of the cooling chamber 12 through the door 13.

A door handle 14 is coupled to a front surface of the door 13. The door handle 14 is configured to be grasped by a user and to facilitate opening and closing of the door 13.

A refrigeration cycle (not shown) for generating cool air to cool the cooling chamber 12 is provided at one side of the body 11. The refrigeration cycle is generally provided on a rear surface of the body 11, and at a lower space of the rear surface (e.g., a mechanic chamber or machine room). The refrigerator 10 may use any type of configuration and operation of the refrigeration cycle.

Cool air generated by the refrigeration cycle is supplied to the cooling chamber 12 through a cool air supply duct (not shown) of the body 11, thereby cooling inside of the cooling chamber 12. A blower (not shown) may be further provided so as to supply cool air to the cool air supply duct.

The cooling chamber 12 may be divided into a refrigerating chamber 12*a* for freshly storing items in a cooled state that is above freezing, and a freezing chamber 12*b* for storing items in a frozen state. The refrigerating chamber 12*a* and the freezing chamber 12*b* may include various structures (e.g., shelves, bins, etc.) according to a consumer's usage patterns and the kinds or amount of storage items.

As shown in FIG. 1, the refrigerating chamber 12*a* may be disposed above the freezing chamber 12*b*, so that a user who uses the refrigerating chamber 12*a* more frequently than the freezing chamber 12*b* can have enhanced convenience when opening and closing the refrigerating chamber 12*a* or storing items in the refrigerating chamber 12*a*.

In this example, a freezing chamber door 13*b* for opening and closing the freezing chamber 12*b* is not coupled to the body 11 by hinges, but is configured to slide in and out in a manner similar to a drawer. Accordingly, a user removes items stored in the freezing chamber 12*b* from above. This may reduce inconvenience of a user having to lower his or her posture to take out the items stored in the freezing chamber 12*b*.

FIG. 1 shows an example of the refrigerator 10 in an ordinary operating orientation. For instance, as shown, when a support structure of the refrigerator 10 rests against the ground, the refrigerating chamber 12*a* is positioned at a relatively upper portion of the main body 11 and the freezing chamber 12*b* is positioned at a relatively lower portion of the main body 11. The ordinary operating orientation may reflect the intended orientation of the refrigerator 10 when being used by a consumer.

In other implementations, the freezing chamber 12*b* may be disposed above the refrigerating chamber 12*a*. Alternatively, the refrigerating chamber 12*a* and the freezing chamber 12*b* may be oriented and positioned at the left and right sides, respectively, in parallel to each other.

The refrigerator 10 is provided with a dispenser 100 through which ice pieces and/or water stored in the cooling chamber 12 can be dispensed to an exterior of the refrigerator 10 without opening the door 13.

An ice making apparatus 15 including an ice maker for freezing ice pieces dispensed through the dispenser 100, and an ice bank for storing the ice pieces made by the ice maker is provided on a surface inside of the cooling chamber 12 or the rear surface of the door 13. The dispenser 100 and the ice making apparatus 15 communicate with each other by a communication unit 140 for communicating an outlet of the ice bank with a guide unit 110 of the dispenser 100.

An opening/closing member 141 for selectively opening the communication unit 140 when transferring ice pieces through the communication unit 140 is provided in the communication unit 140. The opening/closing member 141 has one side coupled to the communication unit 140 or a concaved region 101 by hinges, and is opened and closed by being rotated by an additional unit such as a solenoid 142. Any type of ice maker may be used as the ice making apparatus 15.

Referring to FIGS. 1 to 3, the dispenser 100 is provided on a refrigerating chamber door 13*a*. In other examples, the dispenser 100 may be provided on the freezing chamber door 13*b*.

In the example of the dispenser 100 being positioned on the refrigerating chamber door 13*a* as shown in FIG. 1, an additional space (e.g., an ice making chamber) having a lower temperature than the refrigerating chamber 12*a*, which is maintained at a temperature above zero, is configured to maintain a temperature at or below freezing and, thereby, prevent ice pieces from melting at the temperature of the refrigerating chamber 12*a*. The ice making apparatus 15 and the ice storage bin are installed in the ice making chamber.

Referring to FIGS. 2 and 3, the dispenser 100 includes a guide unit 110 that guides dispensing of ice pieces and/or water, and a dispensing button unit 120 that controls a dispensing start time and a dispensing speed of the ice pieces and/or water dispensed through the guide unit 110.

The dispenser 100 is positioned at a concaved region 150 defined at a predetermined region on a front surface of the door 13. The concaved region 150 is a recess within a thickness direction of the door 13.

The guide unit 110 and the dispensing button unit 120 are accommodated at a stored position in the concaved region 150 when the dispenser 100 is not operated. When water and/or ice pieces are dispensed through the dispenser 100, the guide unit 110 and the dispensing button unit 120 are disposed in a dispensing position with at least a portion (e.g., an outlet) being positioned outside of the concaved region 150 and outside of a front surface of the door 13. The guide unit 110 and the dispensing button unit 120 move between the stored position and the dispensing position based on whether the dispenser is being used to dispense content or not.

As shown in FIGS. 2 and 3, the guide unit 110 and the dispensing button unit 120 are installed in a casing 101 disposed that corresponds to the concaved region 150. In other examples, the guide unit 110 and the dispensing button unit 120 may be directly installed on a wall surface of the door 13 that defines the concaved region 150.

The dispenser 100 includes a driving unit 130 that automatically controls accommodated (e.g., stored) and protruding (e.g., dispensing) states of the guide unit 110 and the dispensing button unit 120 by turning on/off power.

Figure 4:
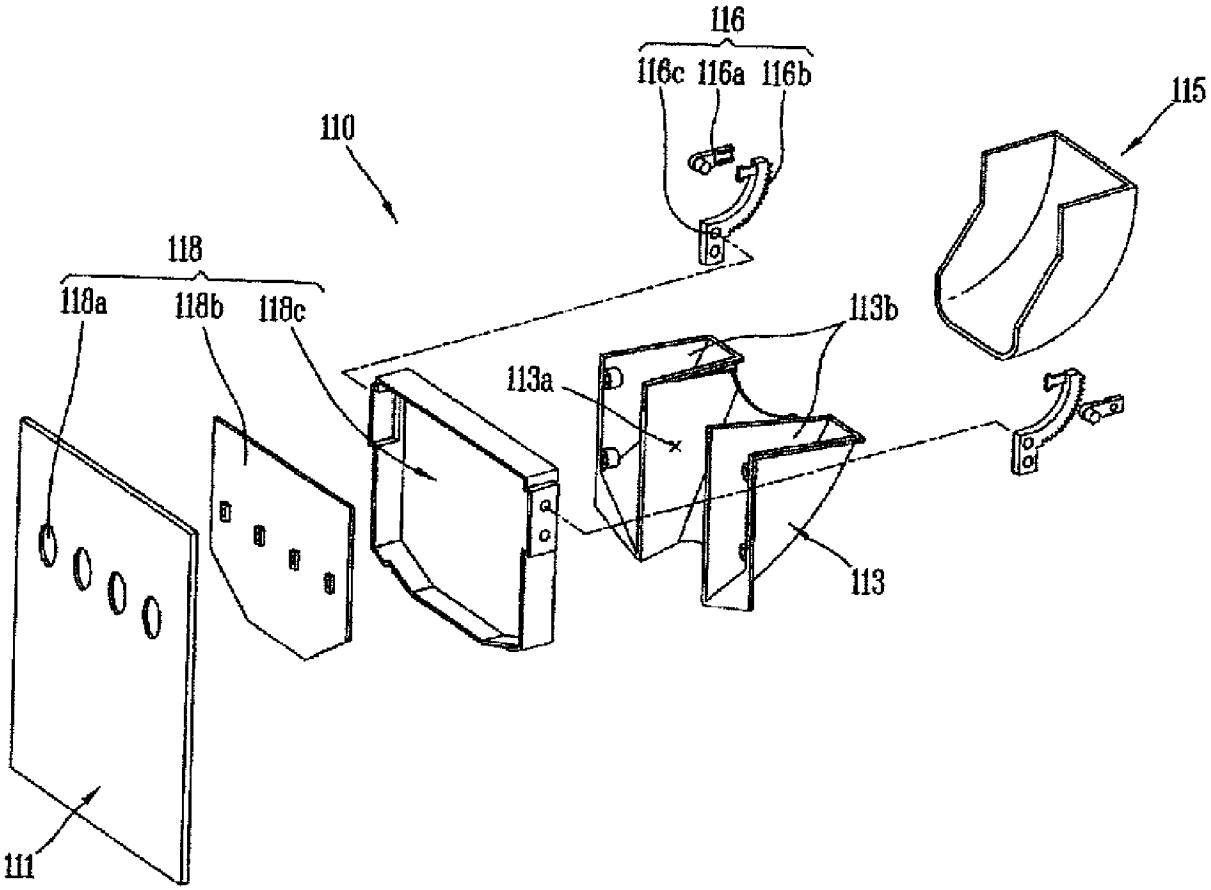
FIG. 4 is an exploded perspective view of a guide unit of FIG. 2.

FIG. 4 illustrates an example of the guide unit of FIG. 2. Referring to FIGS. 1 to 4, the guide unit 110 includes a fixed guide portion 115 and a movable guide portion 113 for guiding dispensing of ice pieces and/or water transferred through the communication unit 140. The guide unit 110 includes a cover portion 111 that is coupled to the movable guide portion 113 and that shields the concaved region 150 when the dispenser 100 is not operated (e.g., when the dispenser 100 is in a stored position).

The fixed guide portion 115 is fixed to the end of the communication unit 140, and guides water and/or ice pieces received from the communication unit 140 to the movable guide portion 113. The movable guide portion 113 has two upper ends coupled to both inner sides of the concaved region 101 by hinges. The hinges enable the movable guide portion 113 to be vertically rotated.

Under this configuration, the movable guide portion 113 rotates in a thickness direction of the door 13, and communicates the fixed guide portion 115 with an exterior of the door 13 when the guide unit 110 is extended to the dispensing position. The movable guide portion 113 and the fixed guide portion 115 define a passage for guiding dispensing of ice pieces and/or water through the door 13 when the guide unit 110 is positioned in the dispensing position.

For example, the movable guide portion 113 is coupled to the cover portion 111 that is at a front surface of the door 13 when the guide unit 110 is in a stored position. The movable guide portion 113 performs a reciprocating motion between a stored position in which the cover portion 111 is disposed on the same plane as a front surface of the door 13, and a dispensing position in which the cover portion 111 is disposed at a front side of the door 13 (e.g., beyond the plane of the front surface of the door 13). In the dispensing position, the movable guide portion 113 communicates with the fixed guide portion 115.

As shown in FIG. 3, in the stored position, the movable guide portion 113 overlaps the fixed guide portion 115 in a thickness direction of the door 13. Based on the overlapping of the movable guide portion 113 and the fixed guide portion 115, a volume of the concaved region 101 needed to accommodate the fixed guide portion 115 and the movable guide portion 113 in the stored position may be reduced. This may minimize volume decrease of the cooling chamber 12 due to the dispenser 100.

The cover portion 111 is configured to shield the opened front surface of the concaved region 101 in the stored position. The opened front surface of the concaved region 101 shielded by the cover portion 111 may correspond to the entire part of the front surface of the door 13 where the concaved region 101 is defined. In some examples, the cover portion 111 has an upper edge that is high enough for an upper end portion 113*u* of the movable guide portion 113 to be blocked by an outside of the door 13, and a lower edge that is positioned high enough such that the cover portion 111 does not cause interference with horizontal motion of the dispensing button unit 120. In these examples, a front surface of the door 13 that is not shielded by the cover portion 111 may be shielded by an additional member fixed on the same plane as the front surface of the door 13, or may be shielded by a surface extending from the front surface of the door 13. In these configurations, power required to drive the movable guide portion 113 may be reduced, and an enhanced appearance when the dispenser 100 is in a stored position may be achieved.

The movable guide portion 113 may be installed so as to rotate with an axis of rotation being around both sides of a front end of the upper end portion 113*u*. The rotation center of the movable guide portion 113 with respect to the thickness direction of the door 13 is spaced above the upper end portion 113*u* of the movable guide portion 113.

In these examples, the movable guide portion 113 may have a large rotation radius without increasing the height of the cover portion 111. Thus, the end of the movable guide portion 113 may have an increased protruding length in the dispensing position with a small rotation angle ($\alpha$) of the cover portion 111. Accordingly, a space available for a container to receive dispensed ice pieces and/or water may be increased. Furthermore, degraded appearance of the dispenser 100 in a dispensing position due to excessive rotation of the cover portion 111 may be reduced. In order to reduce degraded appearance of the dispense 100 in a dispensing position, the cover portion 111 maintains a rotation angle ($\alpha$) of 45~60° from the front surface of the door 13.

A control button unit 118 for controlling the operation of the dispenser 100 may be provided between a rear surface of the cover portion 111 and the movable guide portion 113. The control button unit 118 includes a button printed circuit board (PCB) 118*b* that generates control signals when pressed by a user, a button accommodation portion 118*a* positioned at the cover portion 111 and configured to transmit a pressing force to the button PCB 118*b*, and a PCB accommodation portion 118*c* that accommodates the button PCB 118*b* therein.

The movable guide portion 113 includes a guide body portion 113*a* that guides and passes ice pieces and/or water therethrough, and a guide fixing portion 113*b* disposed at both sides of the guide body portion 113*a* and coupled to a rear surface of the cover portion 111 or the PCB accommodation portion 118*c*.

A hinge portion 116 that rotates the movable guide portion 113 is coupled to two side surfaces of the PCB accommodation portion 118*c*. The hinge portion 116 includes a fixation portion 116*c* fixed to both ends of the PCB accommodation portion 118*c*, a hinge-coupled portion 116*a* that is coupled to the concaved region 101 in a manner that enables rotation, and a driven portion 116*b* that has a circular arc shape and a saw tooth-shaped outer circumference. The driven portion 116*b* is coupled to the driving unit 130 and connects the fixation portion 116*c* to the hinge-coupled portion 116*a*.

Figure 5:
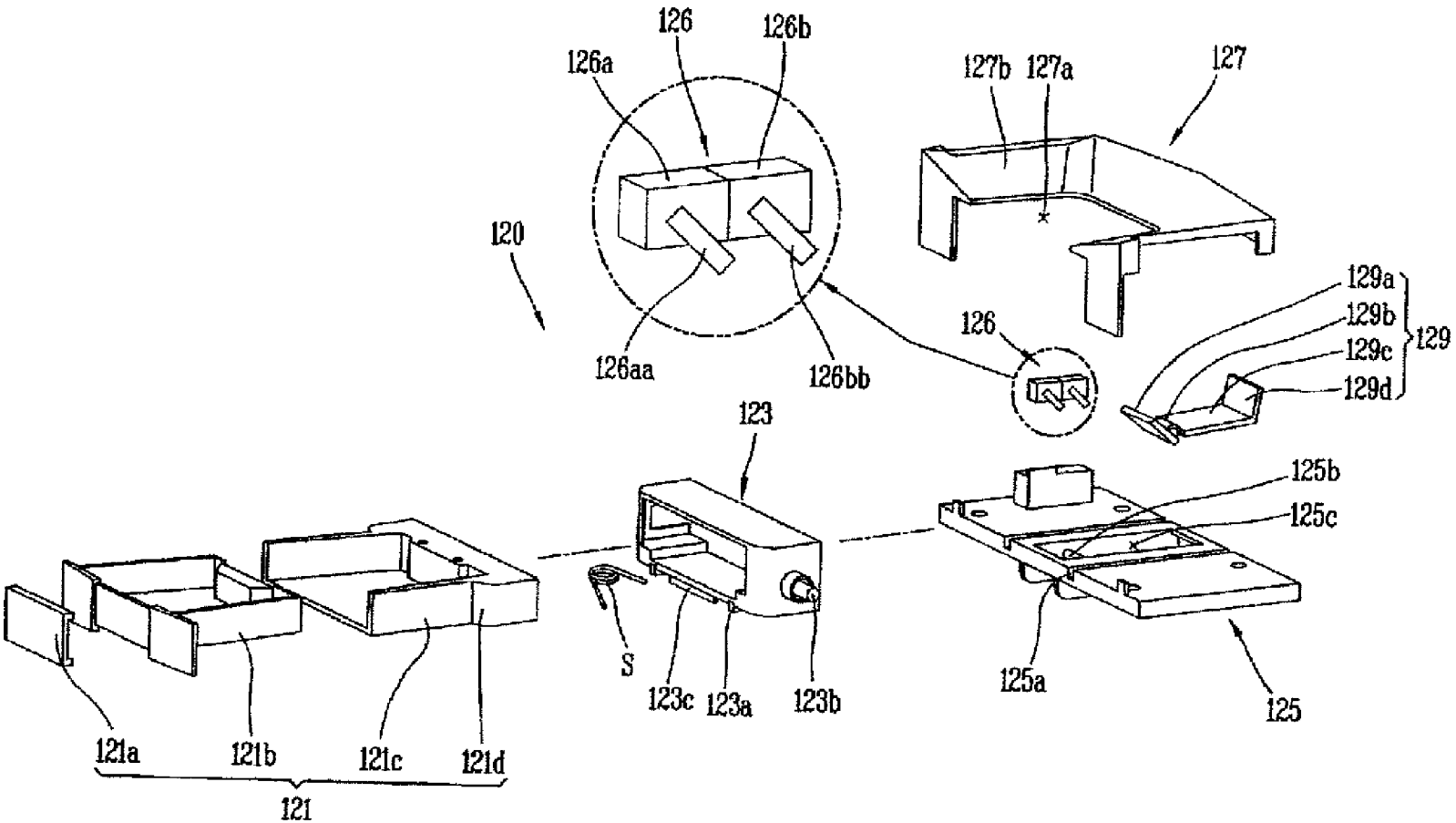
FIG. 5 is an exploded perspective view of a dispensing button unit of FIG. 2.

FIG. 5 illustrates an example of the dispensing button unit of FIG. 2.

Referring to FIGS. 1 to 5, the dispensing button unit 120 includes a lever frame portion 123 disposed below the guide unit 110 and configured to move inside and outside of the concaved region 101 in a plane horizontal to the surface of the door 13. The lever frame portion 123 is configured to move with rotation of the cover portion 111. The dispensing button unit 120 also includes a lever portion 121 elastically coupled to the lever frame portion 123. When the dispenser 100 is in a dispensing position, the lever portion 121 is configured to receive force pressing the lever portion 121 toward the concave region 101 to start dispensing of ice pieces and/or water. A restoring force moves the lever portion 121 toward a front side of the concave region 101 when force pressing the lever portion 121 toward the concave region 101 is removed.

In this configuration, the lever portion 121 generates a dispensing signal of ice pieces and/or water when pressed, in a thickness direction of the door 13, by a container in which ice pieces and/or water is to be received. As an inlet of the container is disposed to face the end of the movable guide portion 113, dispensed ice pieces and/or water are received in the container.

The dispensing button unit 120 may further include a frame guide portion 125 that guides horizontal motion of the lever frame portion 123, and reduces motion of the lever frame portion 123 in other directions (e.g., right and left directions).

The frame guide portion 125 is fixed to a lower surface of the concaved region 101, and the lever frame portion 123 is coupled to an upper surface of the frame guide portion 125 in a manner that enables the lever frame portion 123 to move in a sliding motion. For this, a guide protrusion 123*a* and a guide groove 125*a* are provided on contact surfaces between the frame guide portion 125 and the lever frame portion 123.

The lever portion 121 is provided with a stopping end 121*d* at a side of a rear end thereof. The stopping end 121*d* serves to limit motion of the lever portion 121 by contacting the lever frame portion 123.

In this configuration, a maximum protruding position of the lever portion 121 toward the front side of the concaved region 101 by a restoration force of an elastic member, such as a spring, (S) is determined based on contact of the stopping end 121*d* with the lever frame portion 123. The stopping end 121*d* may be installed on any surfaces of the lever portion 121 such as an upper surface and a lower surface, rather than the side surface.

In some implementations, the lever portion 121 includes a tray 121*b* configured to receive and hold residual content (e.g., ice and/or water) dispensed from the dispenser after a dispensing operation. The tray 121*b* may be an ice bank configured to receive ice pieces. The tray 121*b* has an opened upper surface configured to receive content and one or more recesses configured to retain content received through the opened upper surface.

In this configuration, when the pressed state of the lever portion 121 is released before ice pieces and/or water dispensed through the guide unit 110 are accommodated in a container, the ice pieces and/or water are received and stored in the tray 121*b*. The tray 121*b* may reduce contamination of the peripheries of the lever portion 121 or inside of the to dispenser 100 caused by residual content that is dispensed, but not received in a container.

A container contact portion 121*a* configured to receive contact of a container being pressed against the tray 121*b* is positioned on a front surface of the tray 121*b*. The container contact portion 121*a* is an elastic member so that an impact amount transmitted to the container is attenuated by a restoration force applied to the lever portion 121 when pressing the lever portion 121.

The tray 121*b* of the lever portion 121 may be configured so as to be detachable (e.g., removable and replaceable). For this, the lever portion 121 includes a button body portion 121*c* separate from the tray 121*b*, and to which the tray 121*b* is detachably mounted.

The dispensing button unit 120 includes a ice guide portion 127 disposed between an upper surface of the tray 121*b* and the fixed guide portion 115. The ice guide portion 127 guides ice pieces and/or water abnormally dispensed from the fixed guide portion 115 of the dispenser 100 to the tray 121*b*.

The ice guide portion 127 includes an opening 127*a* that allows ice pieces and/or water to pass through the ice guide portion 127, and an inclined portion 127*b* that is downward inclined toward the circumference of the opening 127*a* and that guides ice pieces and/or water to the opening 127*a*.

In some implementations, the dispensing button unit 120 includes a lever locking unit 129 that determines a position where the lever portion 121 is pressed to the maximum state. Accordingly, a pressed position of the lever portion 121 where water or ice pieces start to be dispensed is made known to a user. This may reduce the possibility of dispensed ice pieces or water falling outside of a container due to a misaligned position of the lever portion 121.

The lever locking unit 129 includes a hinge portion 129*b* disposed below the lever portion 121 and hinge-coupled to the frame guide portion 125, a first extension portion 129*a* that extends at an angle from the hinge portion 129*b* in a first direction (e.g., a forward direction), and a second extension portion 129*c* that extends at an angle from the hinge portion 129*b* in a second direction (e.g., a backward direction). The first extension portion 129*a* protrudes upwardly from a horizontal surface. The lever locking unit 129 also includes a third extension portion 129*d* that extends from an end of the second extension portion 129*c* and faces a rear surface of the lever portion 121 in the dispensing position. The third extension portion 129*d* limits motion of the lever portion 121. The hinge portion 129*b* is coupled to a shaft 125*b* of the frame guide portion 125. An installation groove 125*c* accommodates the lever locking unit 129 therein is further provided at the frame guide portion 125. A pressing protrusion 123*c* is located on a lower surface of the lever frame portion 123. The pressing protrusion 123*c* rotates and fixes the lever locking unit 129 by contacting the first extension portion 129*a* when the lever frame portion 125 moves.

As the lever frame portion 123 moves toward a front side of the door 13, the pressing protrusion 123*c* located on a lower surface of the lever frame portion 123 pushes the first extension portion 129*a*. As the first extension portion 129*a* is pushed, the lever locking unit 129 is rotated centering around the hinge portion 129*b*. Upon completion of the movement of the lever frame portion 123 to a dispensing position, the third extension portion 129*d* is disposed in correspondence to a rear surface of the lever portion 121 based on rotation of the lever locking unit 129.

Because, when in the dispensing position, the first extension portion 129*a* is in a pressed state by the pressing protrusion 123*c* located on a lower surface of the lever frame portion 123, counterclockwise rotation of the lever locking unit 129 as shown in FIG. 3 is restricted. This allows the third extension portion 129*d* to limit horizontal movement of the lever portion 121 when pressed because a rear surface of the lever portion 121 contacts the third extension portion 129*d* and the lever locking unit 129 does not rotate based on the contact.

Once the restricted state of the first extension portion 129*a* by the lever frame portion 123 is released when the lever frame portion 123 moves into the concaved region 150, the second extension portion 129*c* and the third extension portion 129*d* have a larger load than the first extension portion 129*a* are downwardly rotated into the installation groove 125*c*. That is, the lever locking unit 129 is rotated in a clockwise direction based on FIG. 3. As a result, the lever frame portion 123 and the lever portion 121 are accommodated in the concaved region 150 without interfering with the lever locking unit 129.

In addition, a switching unit 126 is provided. The switching unit 126 sequentially generates a dispensing start signal and a dispensing speed signal to change a dispensing start time and a dispensing speed of ice pieces or water when the lever portion 121 is moved in a pressed state. The dispensing start signal causes the dispenser to start dispensing ice and/or water at a first speed that is relatively slow. The dispensing speed signal causes the dispenser to increase a dispensing speed of ice and/or water to a second speed that is relatively fast as compared to the first speed. Accordingly, as a user applies force to the dispensing button unit 120, the switching unit 126 controls the dispenser to first start dispensing ice and/or water at a relatively slow speed and then controls the dispenser to dispense ice and/or water at a relatively fast speed as additional force is applied to the dispensing button unit 120.

The switching unit 126 may be fixed to the frame guide portion 125 so as to be pressed by a side surface of the stopping end 121*d* of the lever portion 121. In this case, the frame guide portion 125 restricts movement of the lever frame portion 123 and the lever portion 121 in right and left directions. Accordingly, contact reliability between the lever portion 121 and the switching unit 126 is enhanced. In some implementations, the position of the switching unit 126 may be different.

The switching unit 126 includes a dispensing start switch 126*a* that generates an electric signal to start dispensing of ice pieces or water. The switching unit 126 also includes a dispensing speed switch 126*b* that generates an electric signal to change a dispensing speed of the ice pieces or water being dispensed.

Generally, the ice bank that stores ice pieces is provided with a transfer device that moves and guides the stored ice pieces to an outlet of the ice bank. Ice pieces or water are dispensed based on input to the switching unit 126, which controls the operation and speed of the transfer device.

The dispensing start switch 126*a* and the dispensing speed switch 126*b* are installed so as to be sequentially pressed as the lever portion 121 is pressed. More specifically, the dispensing speed switch 126*b* is contacted when the lever portion 121 is pressed by a predetermined length after the dispensing start switch 126*a* has been contacted.

As shown in FIG. 5, the dispensing start switch 126*a* and the dispensing speed switch 126*b* may be installed to be spaced apart from each other by a predetermined length. When the lever portion 121 is pressed, the dispensing start switch 126*a* is pressed. While the dispensing start switch

126*a* maintains the pressed state, the lever portion 121 is pressed further by the predetermined length and then presses the dispensing speed switch 126*b*.

In the case that contact terminals 126*aa* and 126*bb* of the switches 126*a* and 126*b* are arranged in a length direction of the lever portion 121, the contact terminal 126*aa* of the dispensing start switch 126*a* may be pressed by the lever portion 121 and thereby press the contact terminal 126*bb* of the dispensing speed switch 126*b*. In some examples, the contact terminals 126*aa* and 126*bb* are installed in parallel to each other at an angle that extends upward or downward. This may reduce an installation space of the switches 126*a* and 126*b* necessary to obtain the predetermine length (L).

The lever portion 121 is elastically supported in the lever frame portion 123. A sliding protrusion 123*b* transmits a driving force to the lever frame portion 123 to horizontally move the lever frame portion 123. The sliding protrusion 123*b* is positioned on an outer side surface of the lever frame portion 123.

Figure 6:
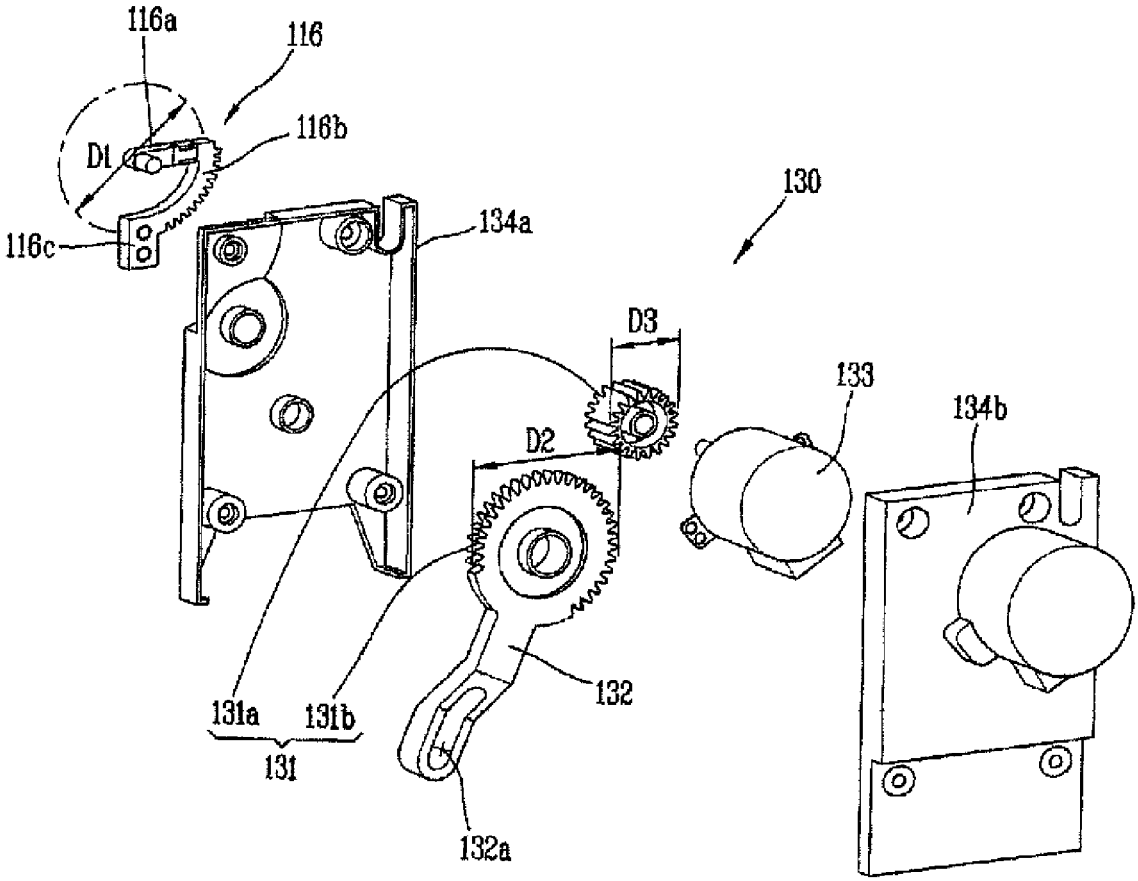
FIG. 6 is an exploded perspective view of a driving unit of FIG. 2.
Figure 7:
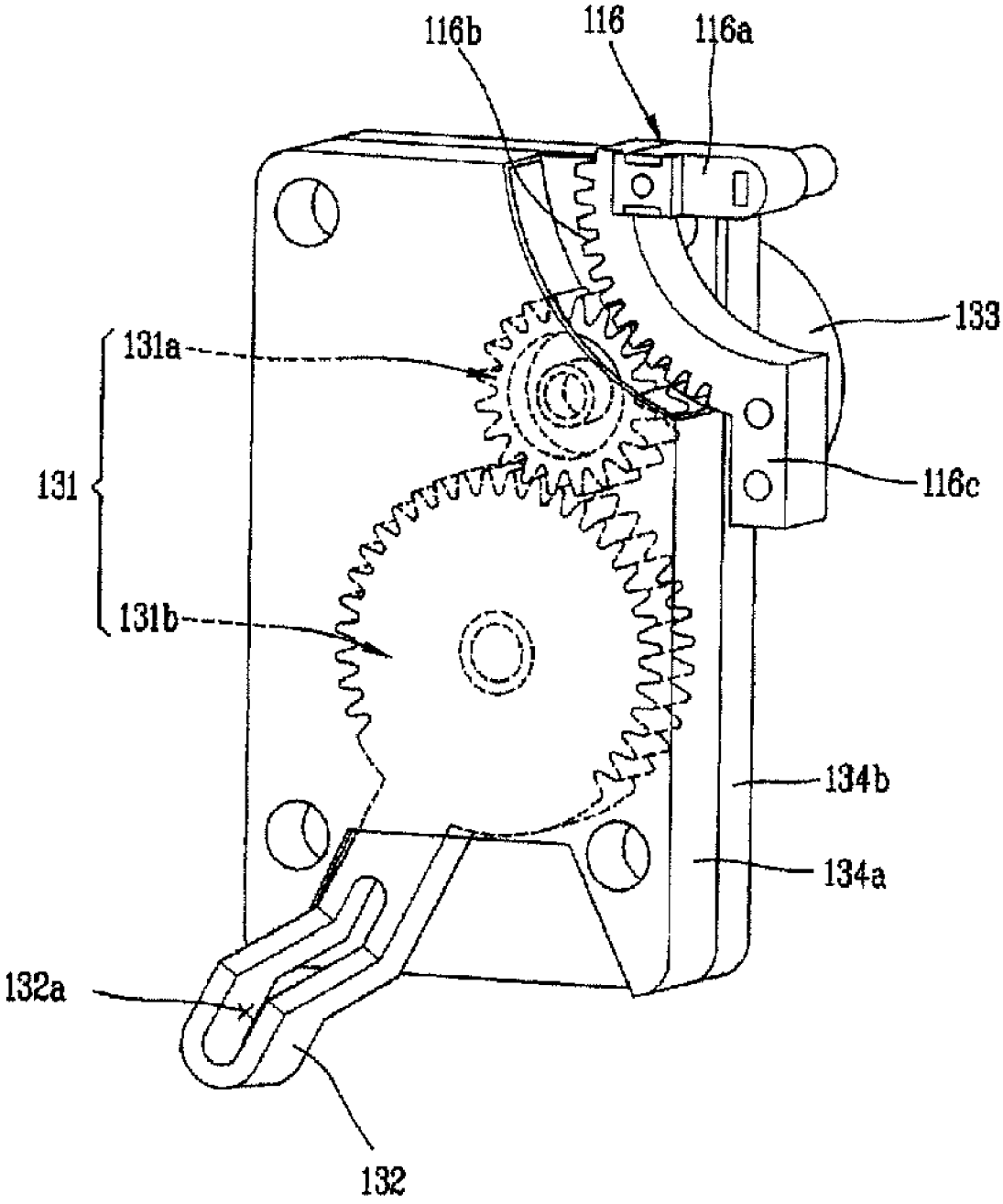
FIG. 7 is a rear perspective view showing an assembled state of the driving unit of FIG. 6.
Figure 8:
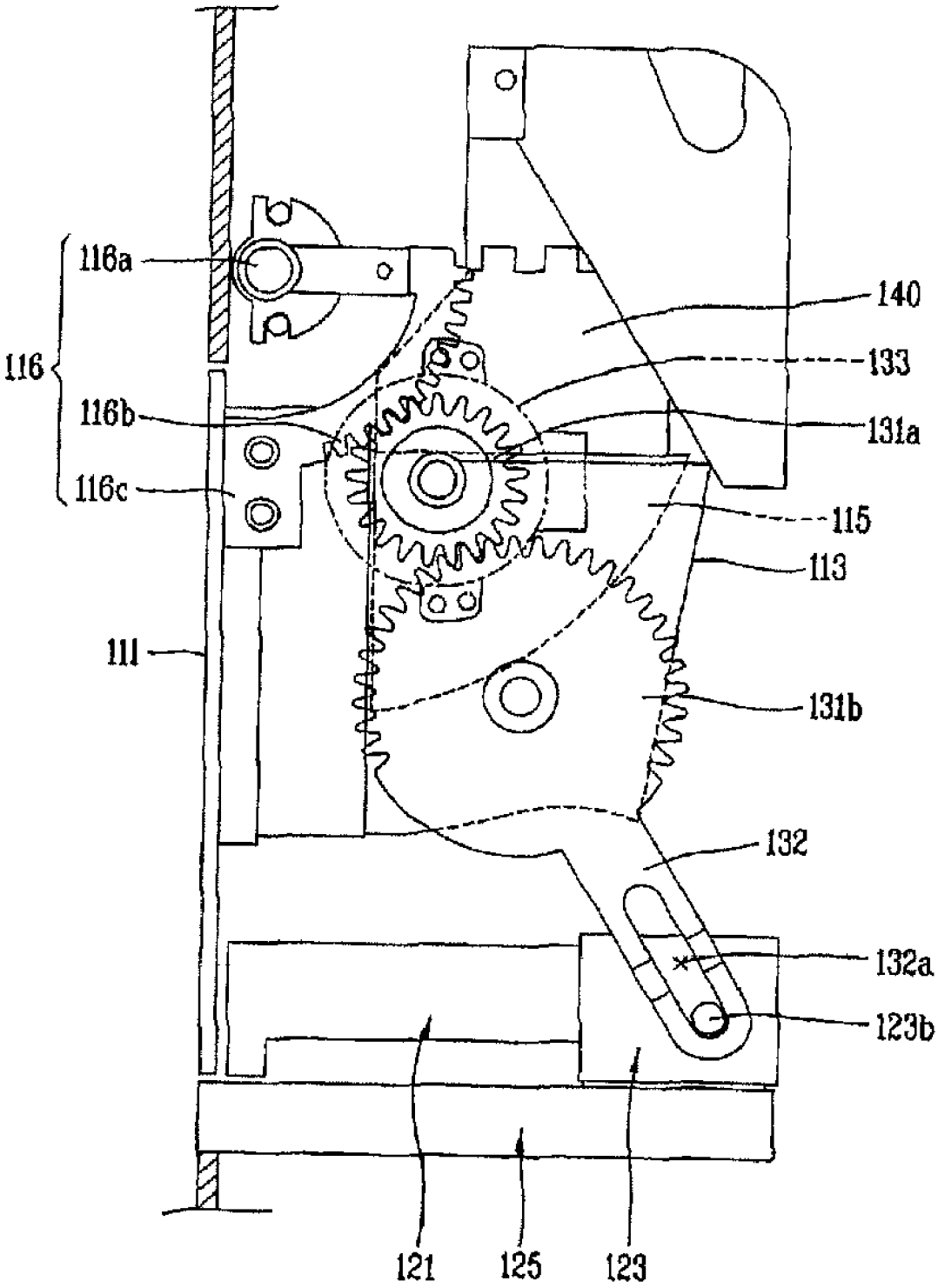
FIG. 8 is a side view of the driving unit when the dispenser is in a standby position state.
Figure 9:
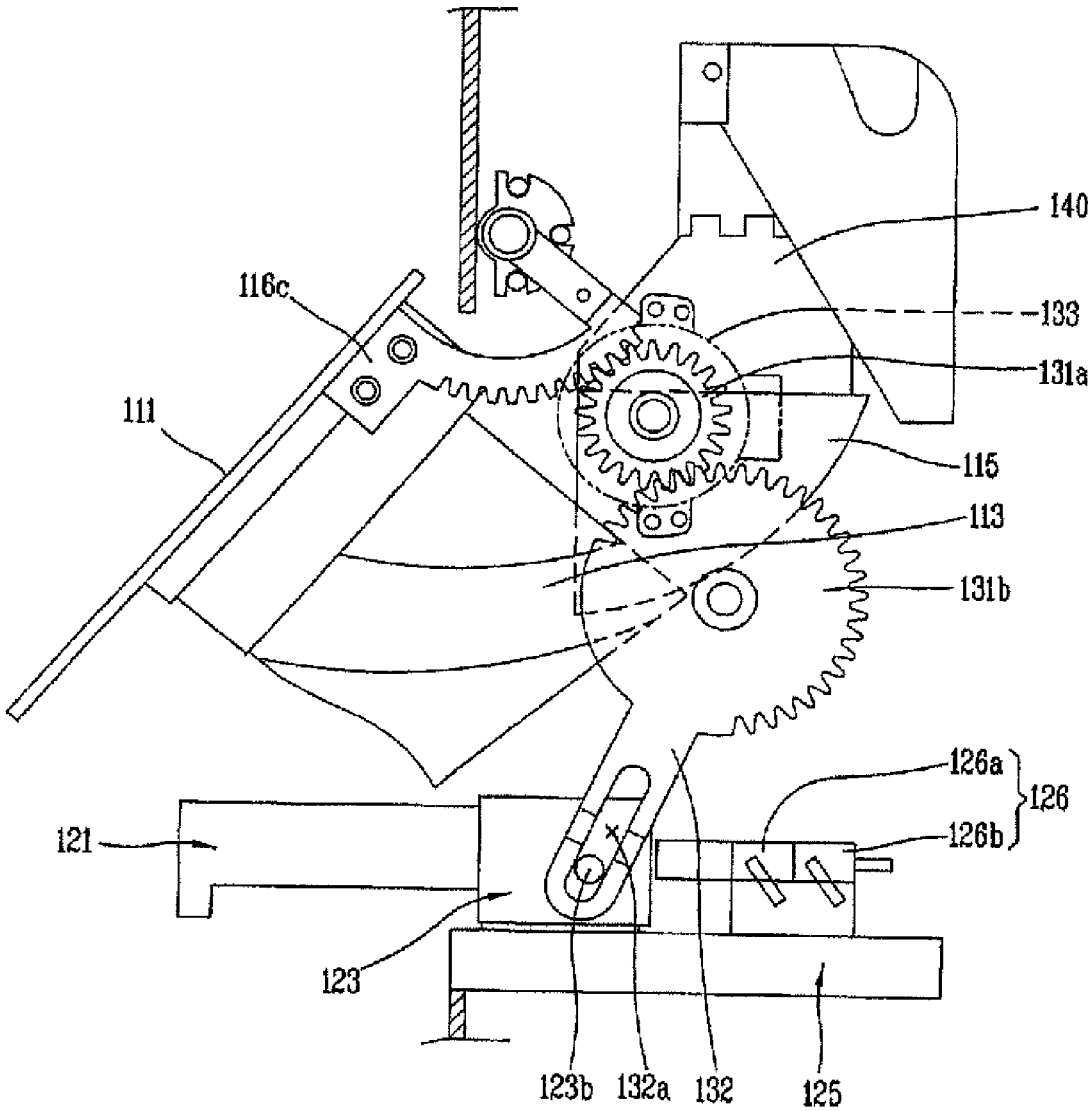
FIG. 9 is a side view of the driving unit when the dispenser is in a dispensing position state.

FIG. 6 illustrates an example of a driving unit, FIG. 7 shows an assembled state of the driving unit of FIG. 6, FIG. 8 shows the driving unit when the dispenser is in a standby position, and FIG. 9 shows the driving unit when the dispenser is in a dispensing position.

Referring to FIGS. 6 and 7, the driving unit 130 includes a gear portion 131 having a plurality of gears engaged with each other and connected to the guide unit 110 and the dispensing button unit 120. The gear portion 131 is configured to transmit a driving force to the dispensing button unit 120. The driving unit 130 also includes a driving motor 133 that transmits a driving force to the gear portion 131, and cover members 134*a* and 134*b* that house the gear portion 131 and the driving motor 133.

As the driving motor 133 rotates, the guide unit 110 and the dispensing button unit 120 move with each other based on rotation of the gear portion 131. The gear portion 131 includes a driving gear 131*a* coupled to the driving motor 133, and a driven gear 131*b* that is engaged with the driving gear 131*a*. The driven gear 131*b* is rotated by the driving gear 131*a* and moves the dispensing button unit 120 based on the rotation.

The driving gear 131*a* also is engaged with the driven portion 116*b* coupled to the movable guide portion 113. The driven portion 116*b* is rotated by the driving gear 131*a* and, thereby, rotates the movable guide portion 113.

The driving gear 131*a*, the driven portion 116*b*, and the driven gear 131*b* are installed so that rotation surfaces thereof are perpendicular to the cover portion 111. Also, a diameter (D1) of the driven portion 116*b* is smaller than a diameter (D2) of the driven gear 131*b*.

Since an angular speed of the driven portion 116*b* due to rotation of the driving gear 131*a* is faster than that of the driven gear 131*b*, a speed difference between the movable guide portion 113 and the dispensing button unit 120 occurs when moving from a stored position to a dispensing position. The speed difference may prevent the dispensing button unit 120 from interfering with the cover portion 111 while the movable guide portion 113 and the dispensing button unit 120 are being moved from a stored position to a dispensing position.

In some examples, a diameter (D3) of the driving gear 131*a* is smaller than the diameter (D1) of the driven portion 116*b* and the diameter (D2) of the driven gear 131*b*. In these examples, protruding speeds of the movable guide portion 113 and the dispensing button unit 120 are decreased to reduce noise. In addition, impact amounts applied to the movable guide portion 113 and the dispensing button unit 120 are reduced.

The driving gear 131*a*, the driven gear 131*b*, and the driving motor 133 are installed at an inner side of the first cover portion 134*a* and the second cover portion 134*b*. A part of the driving gear 131*a* is exposed to through one side of the first cover portion 134*a*, and the driven portion 116*b* is engaged with the exposed part of the driving gear 131*a*.

The driven portion 116*b* is part of a hinge connecting member 116. The hinge connecting member 116 also includes a hinge-coupled portion 116*a* and a fixation portion 116*c*, and has a circular arc shape with a central angle. One end of the driven portion 116*b* is coupled to the hinge-coupled portion 116*a*, which is hinge-coupled to the concaved region 150. Another end of the driven portion 116*b* is coupled to the fixation portion 116*c*, which is fixed to the movable guide portion 113. The central angle of the hinge connecting member 116 is larger than a motion angle of the cover portion 111.

The driven portion 116*b* is provided at a side surface of the concaved region 150. Here, the driven portion 116*b* is supported by idle gears (not shown) rotated by being engaged with the driven portion 116*b*.

The driven gear 131*b* is provided with a sliding lever portion 132 extending in a radius direction of the driven gear 131*b*. The sliding lever portion 132 drives horizontal movement of the lever frame portion 123.

The sliding lever portion 132 is provided with a sliding slot 132*a* in a length direction thereof. A sliding protrusion 123*b* protruding from a side surface of the lever frame portion 123 is inserted into the sliding slot 132*a*.

As the driven gear 131*b* is rotated, the sliding lever portion 132 pushes the sliding protrusion 123*b*. The sliding protrusion 123*b* horizontally moves while performing a sliding motion along the sliding slot 132*a*.

The guide unit 110 and the dispensing button unit 120 of the dispenser 100 may be manually accommodated into or protruded from the door 13 by an elastic member, and a locking member. When the guide unit 110 and the dispensing button unit 120 are in a protruding or dispensing state, the elastic member serves to elastically support the guide unit 110 and the dispensing button unit 120 so as to maintain the protruding or dispensing state. When the guide unit 110 and the dispensing button unit 120 are in an accommodated or stored state, the locking member serves to maintain the accommodated or stored state.

Referring to FIGS. 8 and 9, when the dispenser 100 is in a standby or stored position accommodated in the door 13, the dispenser 100 is completely shielded by the cover portion 111 when viewed from outside of the refrigerator 10. In the standby or stored position, the movable guide portion 113 is disposed so as to overlap the fixed guide portion 115 in a thickness direction of the door 13. Also, the dispensing button unit 120 is accommodated in the concaved region 150 by the sliding lever portion 132.

In the standby or stored position, once a user inputs a signal through the control button unit 118 of the cover portion 111, the driving gear 131*a* is rotated by the driving motor 133 in a counterclockwise direction with reference to FIG. 8. The driven portion 116*b* and the driven gear 131*b* that are each engaged with the driving gear 131*a* are each rotated in a clockwise direction based on rotation of the driving gear 131*a*.

Accordingly, the cover portion 111 and the movable guide portion 113 are rotated around the hinge-coupled portion 116*a* with the center of rotation being at the hinge-coupled portion 116*a*. Based on the rotation, the cover portion 111 and the movable guide portion 113 move toward the front side of the concaved region 150.

The sliding protrusion 123*b* of the lever frame portion 123 is pushed by rotation of the driven gear 131*b*. In response, the sliding protrusion 123*b* horizontally moves toward the front side of the concaved region 150 along the sliding slot 132*a* of the sliding lever portion 132.

When the lever portion 121 is pressed, the dispensing start switch 126*a* and the dispensing speed switch 126*b* disposed on a moving path of the lever portion 121 are sequentially pressed, thereby changing a dispensing start time and a dispensing speed of ice pieces or water. More specifically, when the dispensing start switch 126*a* is pressed, water or ice pieces start to be dispensed. When the lever portion 121 is pressed further into the concaved region 150, the dispensing speed switch 126*b* is also pressed to change a dispensing speed of the water or ice pieces.

The operation to move the dispenser 100 from the dispensing position to the standby position is the reverse of the operation to move the dispenser 100 from the standby position to the dispensing position (e.g., the driving gear 131*a* is rotated by the driving motor 133 is a reverse or opposite direction). Accordingly, the operation to move the dispenser 100 from the dispensing position to the standby position is apparent from the above description of the operation to move the dispenser 100 from the standby to position to the dispensing position.

Figure 10:
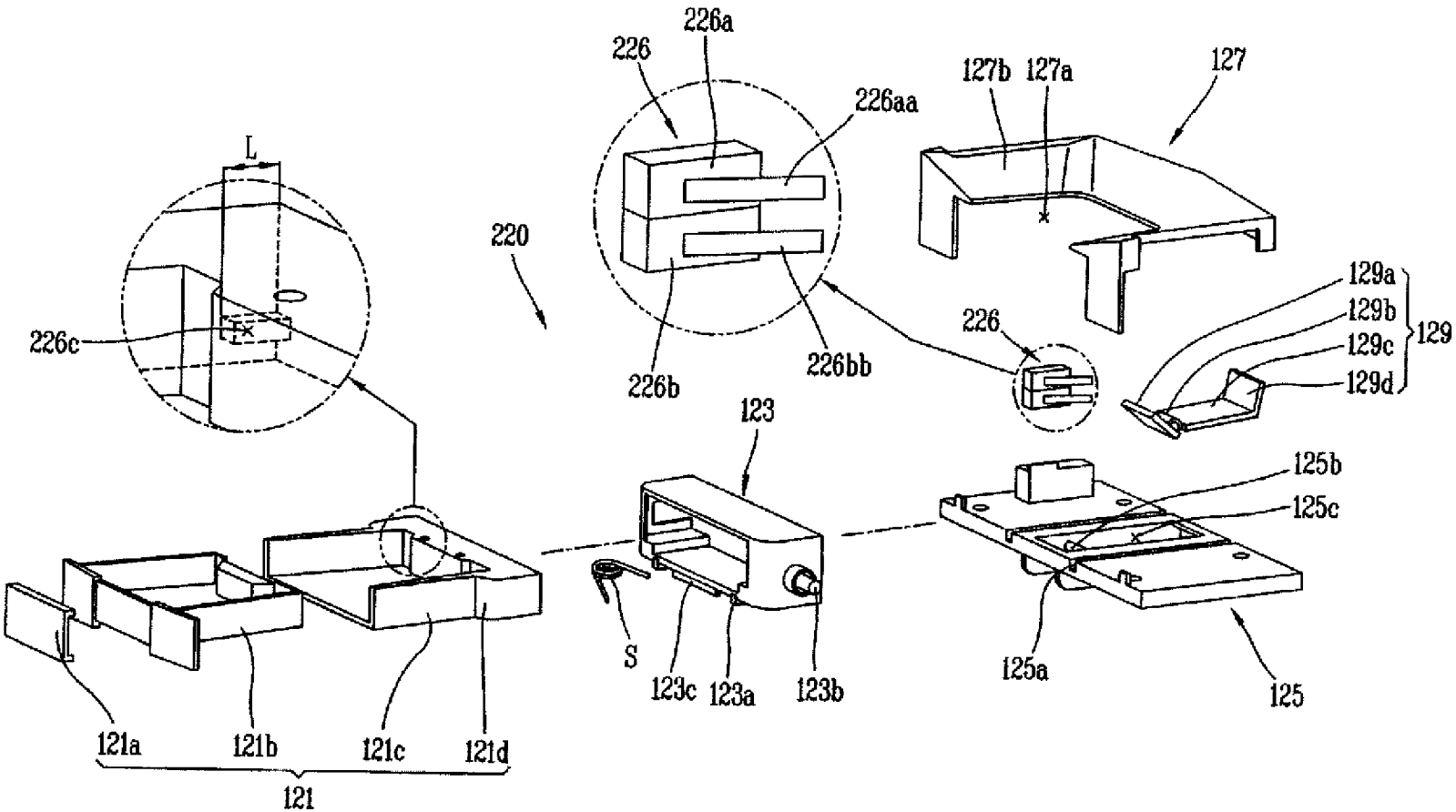
FIG. 10 is an exploded perspective view of a dispensing button unit.

FIG. 10 illustrates another example of a dispensing button unit. Referring to FIG. 10, the refrigerator having a dispenser has features similar to those described above, except for a switching unit 226.

The switching unit 226 is installed so that a dispensing start switch 226*a* and a dispensing speed switch 226*b* are disposed above and below one another at the same horizontal position with respect to the lever portion 121. The dispensing start switch 226*a* and the dispensing speed switch 226*b* have contact terminals 226*aa* and 226*bb*, respectively.

At the stopping end 121*d* of the lever portion 121 that operates the switches 226*a* and 226*b*, a switch groove 226*c* is provided. The switch groove 226*c* accommodates the dispensing speed switch 226*b* when the lever portion 121 is pressed. The switch groove 226*c* is opened toward a rear surface of the lever portion 121, and has a predetermined length (L) in a length direction of the lever portion 121.

As the lever portion 121 is pressed, the dispensing start switch 226*a* is pressed by the stopping end 121*d*. At the same time, the dispensing speed switch 226*b* is accommodated into the switch groove 226*c* and, therefore, is not pressed.

Once the lever portion 121 is pressed further by a predetermined length (L), the dispensing speed switch 226*b* is no longer accommodated into the switch groove 226*c*, and is pressed by the lever portion 121. In some examples, the end of the switch groove 226*c* has an inclined surface or a curved surface, thereby allowing the dispensing speed switch 226*b* to be easily detached from the switch groove 226*c*.

Figure 11:
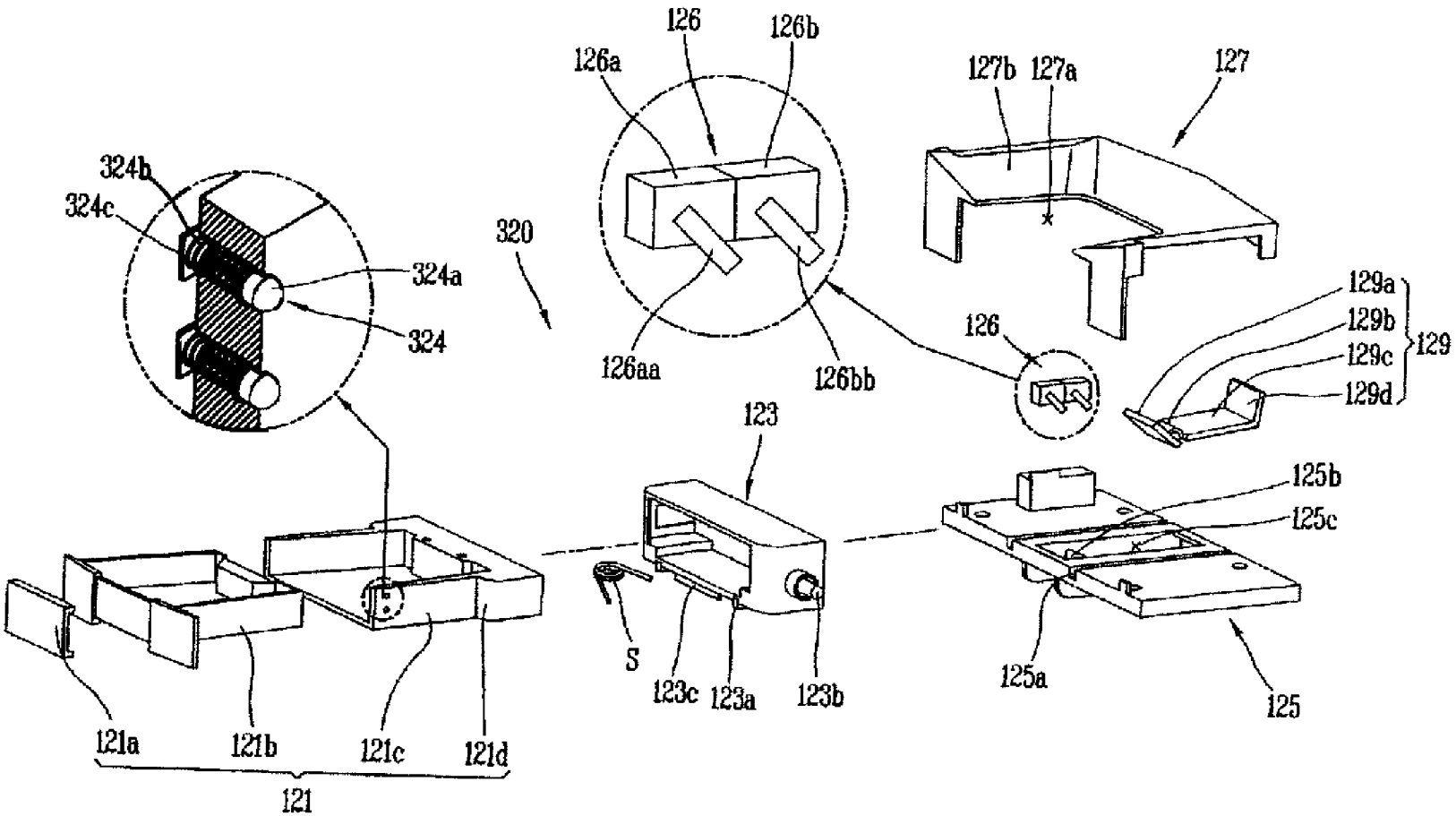
FIG. 11 is an exploded perspective view of a dispensing button unit.

FIG. 11 illustrates another example of a dispensing button unit. Components having the same configurations as those of described above are provided with the same reference numerals. The refrigerator having a dispenser has features similar to those described above, except for a dispensing button unit 320.

The dispensing button unit 320 is further provided with a position informing unit 324 provides output to a user that indicates a position of the lever portion 121. For instance, the position informing unit 324 informs the user when the lever portion 121 is disposed at a position prior to pressing the dispensing speed switch 126*b*.

The position informing unit 324 includes a locking protrusion 324*a* elastically supported at one of the lever portion 121 and the lever frame portion 123, an elastic member 324*b* that elastically supports the locking protrusion 324*a*, and a fixing member 324*c* that fixes the elastic member 324*b*. The position informing unit 324 may be further provided with a locking groove located at the other of the lever portion 121 and the lever frame portion 123 in correspondence to the locking protrusion 324*a*.

Once the dispensing start switch 126*a* is pressed as the lever portion 121 is pressed, a relative motion between the lever portion 121 and the lever frame portion 123 is limited by the position informing unit 324. This may allow a user to sense a changed dispensing speed when more pressing the lever portion 121.

Referring to FIG. 11, the position informing unit 324 is located at one side surface of the lever portion 121. However, the position informing unit 324 may be located at both side surfaces of the lever portion 121. Any installation position of the position informing unit 324 may be used according to the positions of the dispensing start switch 126*a* and the dispensing speed switch 126*b*.

The locking protrusion 324*a* may have an upward inclined portion and a downward inclined portion in a direction in which the lever portion 121 is pressed. This may reduce limitations of a relative motion between the lever portion 121 and the lever frame portion 123 by the locking protrusion 324*a*.

Figure 12:
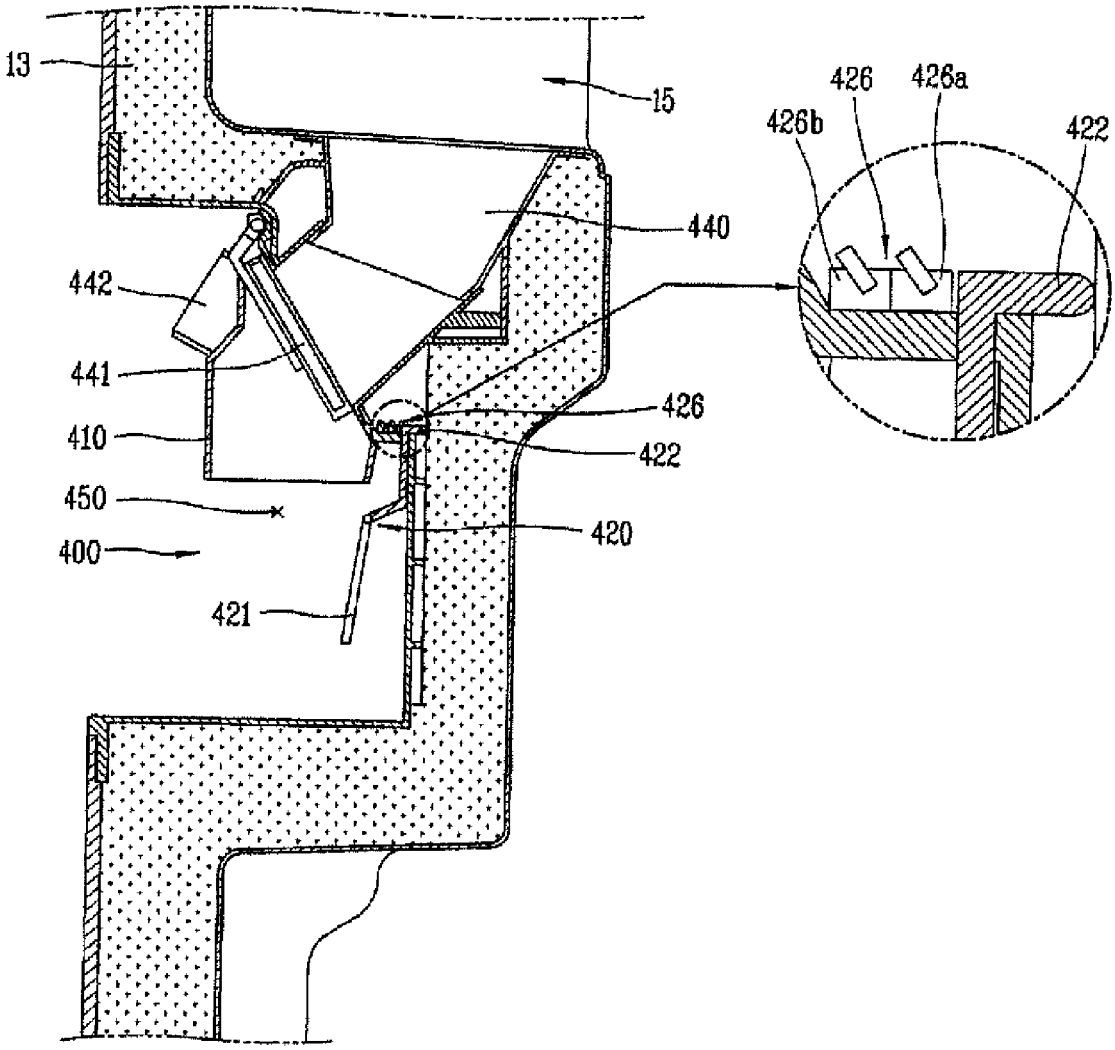
FIG. 12 is a sectional view of a refrigerator having a dispenser.

FIG. 12 illustrates another example of a dispenser 400. Referring to FIG. 12, the refrigerator having a dispenser 400 includes a concaved region 450 (e.g., a dispensing cavity that accommodates insertion of a container) concaved in a thickness direction of the door 13 so as to be opened toward a front side of the door 13. The dispenser 400 also includes a guide unit 410 disposed in the concaved region 450 in communication with a communication port 440 that communicates with an outlet of an ice bank 15. The guide unit 410 and the communication port 440 guide water or ice pieces dispensed from the ice bank 15. The guide unit 410 receives ice and/or water when an opening/closing member 441, which selectively opens and closes the communication port 440, opens the communication port 440. The opening/closing member 441 has one side coupled to the communication port 440 or the concaved region 450 by hinges, and is opened and closed by being rotated by an additional unit such as a solenoid 442.

The dispenser 400 further includes a dispensing button unit 420 for controlling a dispensing start time and a dispensing speed of water or ice pieces dispensed through the guide unit 410. The dispensing button unit 420 includes a pressing portion 421 disposed at an inner side of the concaved region 450, and a switch operating portion 422 that operates a switching unit 426. Specifically, the switch operating portion 422 sequentially operates a dispensing start switch 426*a* and a dispensing speed switch 426*b*.

The dispensing start switch 426*a* and the dispensing speed switch 426*b* generate a dispensing start signal and a dispensing speed signal of water or ice pieces, respectively, based on how much the pressing portion 421 is pressed. The pressing portion 421 and the switch operating portion 422 extend from a hinge shaft the is hinge-coupled to one side surface of the concaved region 450, respectively, toward an inside of the concaved region 450 and inside of the door 13.

Figure 13:
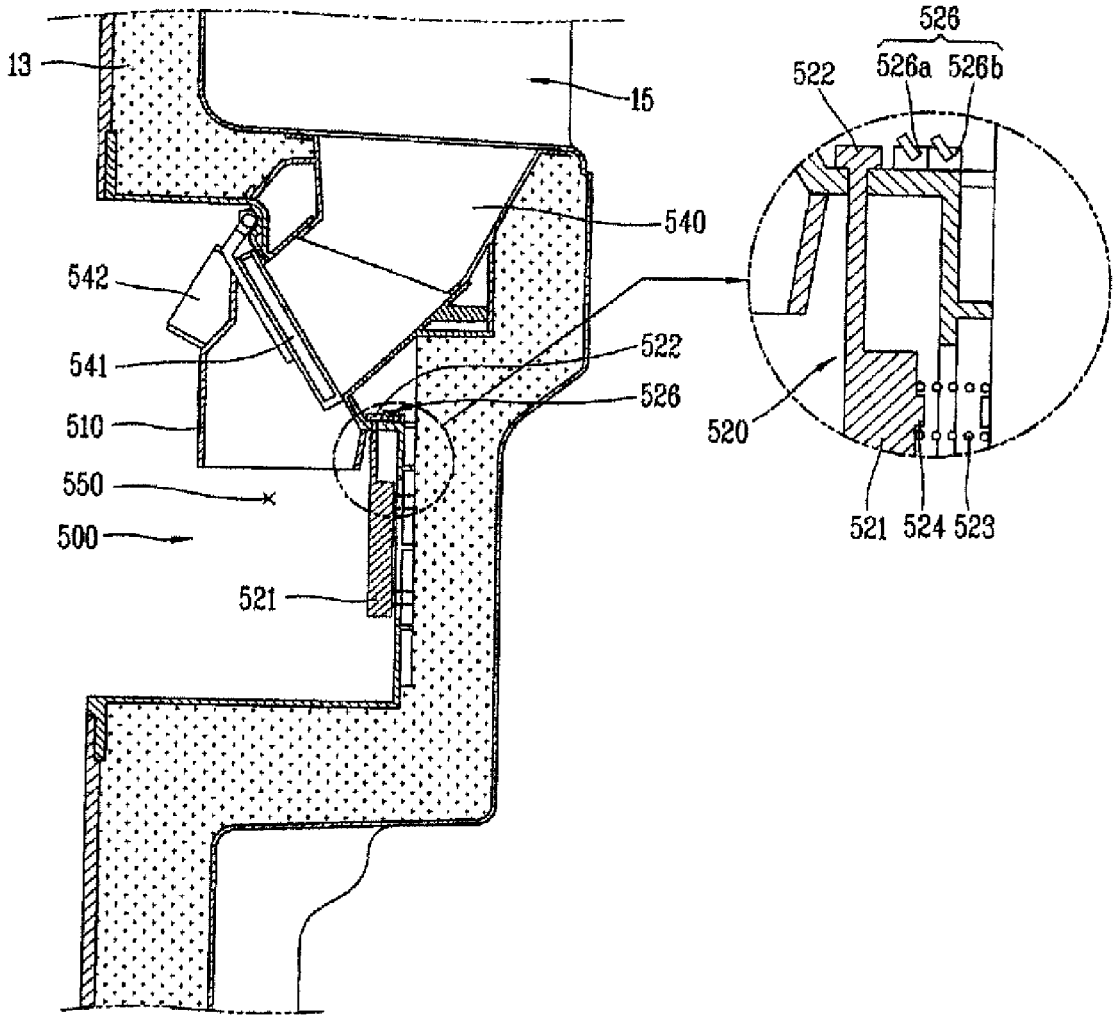
FIG. 13 is a sectional view of a refrigerator having a dispenser.

FIG. 13 illustrates another example of a dispenser 500. Referring to FIG. 13, the dispenser 500 includes a concaved region 550 (e.g., a dispensing cavity that accommodates insertion of a container) concaved in a thickness direction of the door 13 so as to be opened toward a front side of the door 13. The dispenser 500 also includes a guide unit 510 disposed in the concaved region 550 in communication with a communication port 540 that communicates with an outlet of an ice bank 15. The guide unit 510 and the communication port 540 guide water or ice pieces dispensed from the ice bank 15. The guide unit 510 receives ice and/or water when an opening/closing member 541, which selectively opens and closes the communication port 540, opens the communication port 540. The opening/closing member 541 has one side coupled to the communication port 540 or the concaved region 550 by hinges, and is opened and closed by being rotated by an additional unit such as a solenoid 542.

The dispenser 500 further includes a dispensing button unit 520 that controls a dispensing start time and a dispensing speed of water or ice pieces dispensed through the guide unit 510. The dispensing button unit 520 includes a pressing portion 521 disposed at an inner side of the concaved region 550, and a switch operating portion 522 that sequentially operates a dispensing start switch 526*a* and a dispensing speed switch 526*b*. The dispensing start switch 526*a* and the dispensing speed switch 526*b* generate a dispensing start signal and a dispensing speed signal of water or ice pieces, respectively, based on how far the pressing portion 521 has been pressed.

The pressing portion 521 is fixed to a rear inner side of the concaved region 550 with a plurality of elastic members 523 coupled to a rear surface 524 thereof. This structure allows the pressing portion 521 to be elastically supported in a thickness direction of the door 13.

The switch operating portion 522 upwardly extends from an upper side of the pressing portion 521. When the pressing portion 521 is pressed, the switch operating portion 522 serves to first contact the dispensing start switch 526*a* and then contact the dispensing speed switch 526*b* as the pressing portion 521 is pressed.

Although the above disclosure has described a single dispensing start switch and a single dispensing speed switch, some implementations may include multiple switches. For instance, multiple, different dispensing speed switches may be provided to enable user control of multiple, different dispensing speeds depending on how much force the user applies to the dispensing button unit. In this regard, in some examples, the dispenser includes a dispensing start switch, a first dispensing speed switch, and a second dispensing speed switch. In these examples, as the dispensing button unit is pressed by a user, the dispensing button unit first contacts the dispensing start switch, then contacts the first dispensing speed switch, and finally contacts the second dispensing speed switch. When the dispensing button unit contacts the dispensing start switch, the dispenser begins dispensing of ice and/or water at a relatively slow speed. As the dispensing button unit is pressed further by the user and contacts the first dispensing speed switch, the dispenser increases a dispensing speed of ice and/or water to a relatively medium speed that is faster than the relatively slow speed. As the dispensing button unit is pressed further by the user and contacts the second dispensing speed switch, the dispenser further increases a dispensing speed of ice and/or water to a relatively fast speed that is faster than the relatively medium speed.

In some implementations, as a user releases force applied to a dispensing button unit, the dispensing button unit stops contacting a dispensing speed switch, but continues to contact a dispensing start switch. In these implementations, the dispenser decreases dispensing speed of ice and/or water when the dispensing button unit stops contacting a dispensing speed switch, but continues to contact a dispensing start switch. As such, a user is able to control the dispenser to decrease dispensing speed by releasing force applied to a dispensing button unit.

Although the above disclosure has described a dispensing speed switch that is contacted subsequent to a dispensing start switch to increase a dispensing speed of ice and/or water, in some examples, contacting the dispensing speed switch causes the dispenser to decrease a dispensing speed of ice and/or water. In these examples, the dispensing start signal causes the dispenser to start dispensing ice and/or water at a first speed that is relatively fast, and the dispensing speed signal causes the dispenser to decrease a dispensing speed of ice and/or water to a second speed that is relatively slow as compared to the first speed. Accordingly, as a user applies force to the dispensing button unit, the switching unit controls the dispenser to first start dispensing ice and/or water at a relatively fast speed and then controls the dispenser to dispense ice and/or water at a relatively slow speed as additional force is applied to the dispensing button unit.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator having a dispenser, comprising:

a cooling chamber;

a door that is configured to open and close at least a portion of the cooling chamber;

a dispenser positioned on the door and configured to dispense ice pieces or water through the door when the door is oriented in a closed position; and a dispensing button unit configured to control a dispensing start time and a dispensing speed of the ice pieces or water dispensed through the dispenser based on a position of at least a portion of the dispensing button unit that results from movement of the portion of the dispensing button unit, the dispensing button unit being configured to, in response to the portion of the dispensing button unit being moved to a first position, control the dispenser to start dispensing the ice pieces or water at a first speed and being configured to, in response to the portion of the dispensing button unit being moved to a second position that is different than the first position, control the dispenser to change a dispensing speed of the ice pieces or water to a second speed that is different than the first speed, wherein the dispensing button unit further comprises:

a lever portion that is configured to move between the first position and the second position, a dispensing start switch that is positioned to contact the lever portion when the lever portion is moved to the first position and that is configured to generate the dispensing start signal when contacted by the lever portion, and a dispensing speed switch that is positioned to contact the lever portion when the lever portion is moved to the second position and that is configured to generate the dispensing speed signal when contacted by the lever portion.

2. The refrigerator having a dispenser of claim 1, wherein the dispensing button unit comprises:

a lever frame portion configured to move, in a plane perpendicular to a surface of the door, between a stored position at which the lever frame portion is positioned on a side of the surface of the door where the cooling chamber is positioned and an extended position at which at least a portion of the lever frame portion is positioned on a side of the surface of the door opposite of the cooling chamber; and a lever portion that is elastically supported by the lever frame portion and that is configured to, when the lever frame portion is oriented in the extended position, move, in response to application of force to the lever portion, toward the surface of the door and move, in response to release of the force applied to the lever portion, away from the surface of the door.

3. The refrigerator having a dispenser of claim 2, further comprising a position informing unit that is configured to enhance user detection that, subsequent to the lever portion being moved to the first position at which the lever portion contacts the dispensing start switch, the lever portion is disposed at a position before contacting the dispensing speed switch.

4. The refrigerator having a dispenser of claim 3, wherein the position informing unit comprises:

a locking protrusion that is elastically supported at one of the lever portion and the lever frame portion; and a locking groove that is defined at the other of the lever portion and the lever frame portion and that is configured to contact the locking protrusion subsequent to the lever portion being moved to the first position at which the lever portion contacts the dispensing start switch and prior to the lever portion being moved to the second position at which the lever portion contacts the dispensing speed switch, wherein contact between the locking protrusion and the locking groove causes additional resistance in moving the lever portion toward the surface of the door and, thereby, enhances user detection that the lever portion is disposed at a position before contacting the dispensing speed switch.

5. The refrigerator having a dispenser of claim 4, wherein the locking protrusion is elastically supported by a contact surface between the lever portion and the lever frame portion in a vertical direction.

6. The refrigerator having a dispenser of claim 4, wherein the locking protrusion sequentially has an upward inclination portion and a downward inclination portion along a moving direction of the lever portion.

7. The refrigerator having a dispenser of claim 2, wherein, when the door is oriented in the closed position, the dispenser defines an ice flow passage that enables passage of ice pieces through the door from an outlet of an ice bank that is disposed in the cooling chamber and that is configured to store ice pieces.

8. The refrigerator having a dispenser of claim 7, wherein the dispenser comprises:

a fixed guide portion configured to communicate with the outlet of the ice bank; and a movable guide portion that is configured to rotate between a stored position and a dispensing position and that is configured to communicate the fixed guide portion with an exterior of the cooling chamber when the movable guide portion is oriented in the dispensing position.

9. The refrigerator having a dispenser of claim 8, wherein the movable guide portion is coupled to a cover portion that is configured to rotate between a stored position at which the cover portion is positioned in a plane of an external surface of the door and a dispensing position at which at least a portion of the cover portion is positioned on a side of the surface of the door opposite of the cooling chamber and at which the movable guide portion communicates with the fixed guide portion.

10. The refrigerator having a dispenser of claim 9, wherein the dispensing button unit is positioned behind the cover portion when the cover portion is oriented in the stored position, and at least a portion of the dispensing button unit is positioned on the side of the surface of the door opposite of the cooling chamber when the cover portion is oriented in the dispensing position.

11. The refrigerator having a dispenser of claim 1, wherein the dispensing button unit comprises:

a pressing portion disposed at an inner side of a concaved region of the door; and a switch operating portion that is configured to move in response to force applied to the pressing portion, that is configured to, when the door is oriented in the closed position and force is applied to the pressing portion, move toward the cooling chamber to the first position at which the switch operating portion contacts the dispensing start switch, and that is configured to, when the door is oriented in the closed position, the switch operating portion is positioned at the first position, and force is applied to the pressing portion, move toward the cooling chamber to the second position at which the switch operating portion contacts the dispensing speed switch.

12. The refrigerator having a dispenser of claim 11, wherein, when the door is oriented in the closed position, the dispenser defines an ice flow passage between one side of the concaved region and an outlet of an ice bank that is disposed in the cooling chamber and that is configured to store ice pieces.

13. The refrigerator having a dispenser of claim 11, wherein the pressing portion is provided on a wall surface inside the concaved region and is elastically supported in a thickness direction of the door.

14. The refrigerator having a dispenser of claim 11, wherein the pressing portion is coupled to the door by hinges, is configured to rotate in a thickness direction of the door, is provided on a wall surface inside the concaved region, and is elastically supported in a manner that applies a force to rotate the pressing portion toward a front surface of the door.

15. A refrigerator having a dispenser, comprising:

a cooling chamber;

a door that is configured to open and close at least a portion of the cooling chamber;

a dispenser positioned on the door and configured to dispense ice pieces or water through the door when the door is oriented in a closed position;

a dispensing button unit configured to receive force that results in movement of at least a portion of the dispensing button unit; and means for controlling the dispenser to start dispensing the ice pieces or water at a first speed in response to the portion of the dispensing button unit being moved to a first position;

means for controlling the dispenser to change a dispensing speed of the ice pieces or water to a second speed that is different than the first speed in response to the portion of the dispensing button unit being moved to a second position that is different than the first position, wherein the dispensing button unit further comprises:

a dispensing start switch that is positioned to contact the portion of the dispensing button unit when the portion of the dispensing button unit is moved to the first position and that is configured to generate the dispensing start signal when contacted by the portion of the dispensing button unit; and a dispensing speed switch that is positioned to contact the portion of the dispensing button unit when the portion of the dispensing button unit is moved to the second position and that is configured to generate the dispensing speed signal when contacted by the portion of the dispensing button unit.

* * * * *